US008995233B2

(12) United States Patent
Goeller et al.

(10) Patent No.: US 8,995,233 B2
(45) Date of Patent: Mar. 31, 2015

(54) ASTRONOMICAL WATCH

(71) Applicant: Montres Breguet SA, L'Abbaye (CH)

(72) Inventors: Eric Goeller, Colombier (CH); Alain Zaugg, Le Sentier (CH)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 14/069,523

(22) Filed: Nov. 1, 2013

(65) Prior Publication Data

US 2014/0126336 A1 May 8, 2014

(30) Foreign Application Priority Data

Nov. 6, 2012 (EP) ..... 12191477

(51) Int. Cl.
*G04B 19/26* (2006.01)

(52) U.S. Cl.
CPC ..... *G04B 19/262* (2013.01); *G04B 19/268* (2013.01)
USPC ..... 368/15; 368/18

(58) Field of Classification Search
CPC ..... G04B 19/262; G04B 19/268
USPC ..... 368/14–20; 434/284, 292
See application file for complete search history.

(56) References Cited

U.S. PATENT DOCUMENTS

| | | | | |
|---|---|---|---|---|
| 3,766,727 A | | 10/1973 | Didik | |
| 4,435,795 A | * | 3/1984 | Frank | 368/16 |
| 4,671,669 A | * | 6/1987 | Graves | 368/17 |
| 4,711,583 A | * | 12/1987 | Oechslin et al. | 368/16 |
| 5,344,325 A | * | 9/1994 | Wang | 434/288 |
| 5,457,663 A | * | 10/1995 | Mejaski | 368/15 |
| 5,701,678 A | * | 12/1997 | Wang | 33/268 |
| 7,859,948 B2 | * | 12/2010 | Plomb | 368/16 |
| 2012/0294125 A1 | * | 11/2012 | Laramee | 368/17 |

FOREIGN PATENT DOCUMENTS

| | | |
|---|---|---|
| FR | 348.040 | 3/1905 |
| FR | 2 679 052 | 1/1993 |
| WO | 91/11756 | 8/1991 |

OTHER PUBLICATIONS

European Search Report issued Apr. 25, 2013, in Patent Application No. EP 12 19 1477, filed Nov. 6, 2012 (with English-language translation).

G. Glaser, "Astronomische Indikationen Bei Uhren", Jahrbuch Der Deutschen Gesellschaft Fur Chronometrie, vol. 40, XP 000102620, Jan. 1989, pp. 139-161.

* cited by examiner

*Primary Examiner* — Vit W Miska
(74) *Attorney, Agent, or Firm* — Oblon, McClelland, Maier & Neustadt, L.L.P.

(57) ABSTRACT

Mechanism for displaying the day and phase of at least a first celestial body, comprising a gear train for a constant frequency gear drive on an output of a timepiece movement. This mechanism includes a means for the three-dimensional display of the day and phase of said first celestial body represented by a first mobile component, which is driven by the gear train, which includes a phase train and a day train, each in mesh on an output of this same movement.
This phase train and/or this day train include at least one uncoupling means between the input and its output thereof.

18 Claims, 7 Drawing Sheets

ASTRONOMICAL WATCH

This application claims priority from European patent application no. 12191477.4 filed Nov. 6, 2012, the entire disclosure of which is incorporated herein by reference.

FIELD OF THE INVENTION

The invention concerns a mechanism for displaying the day and the phase of at least one celestial body, comprising a gear train for a constant frequency gear drive on an output of a timepiece movement, said mechanism including a means for the three-dimensional display of the day and the phase of said first celestial body symbolised by a first mobile component, said means being driven by said gear train, which includes a phase train and a day train, each in mesh on an output of the same said movement.

The invention also concerns a movement including a drive means for driving at least one such display mechanism.

The invention also concerns an astronomical watch including at least one movement of this type, and/or at least one mechanism of this type.

The invention concerns the field of mechanical horology, and in particular, complications for displaying the state of certain celestial bodies.

BACKGROUND OF THE INVENTION

Astronomical watches are among the watches with complications appreciated by users. Their accuracy is often approximate as regards the display of the cycles of certain celestial bodies, in particular lunar cycles, often because of the small volume available inside the movement, which generally cannot house the large number of wheels which would be necessary to ensure an accurate estimate of the duration of the lunar day and month.

Further, it is often impractical to view the celestial body phases. Most timepiece displays have abandoned the illustration of the celestial body day.

WO Patent No 91/11756 A1 in the name of Richard discloses a Moon display with a first circular plate whose rotation is maintained by a drive mechanism of the watch, with a sphere representing the Moon, able to be moved with this circular support along an aperture arranged in the watch dial. The drive mechanism includes a means of driving the circular support in rotation relative to the aperture, at a speed in keeping with the speed of the apparent movement of the Moon in the sky between rising and setting. The mechanism drives in rotation a second plate at a similar speed to that of the first plate, the second plate drives a pinion which causes the sphere to turn about an axis parallel to the watch dial.

The technical article of the *Jahrbuch der deutschen Gesellschaft für Chronometrie*, in the name of GLASER <<Astronomische Indikationen bei Uhren>>, published on 1 Jan. 1989, vol. 40, pages 139-161, XP000102620, ISSN 0373-7616, discloses a representation of the Moon phases by means of a rotating sphere or rotating discs. A differential drive element drives at suitable speeds both the sphere in rotation on its arbour, and the arbour relative to the dial.

U.S. Pat. No. 3,766,727A in the name of DIDIK discloses a planet clock with a complex gear train driving the planets of the solar system represented by spheres, with the Moon pivoting about the Earth mounted on an inclined arbour, and wherein the driving of the inclined Earth arbour, the Earth about the arbour, and the Moon about the Earth, is performed by as many pulleys in mesh with axial cannon-pinions of the movement.

FR Patent No 12 679 052 A1 in the name of GHIRIMOLDI discloses a planetarium timepiece mechanism with a solid representation.

FR Patent No 348 040 A in the name of Burke discloses an astronomical clock with some celestial bodies motorised with respect to others.

SUMMARY OF THE INVENTION

The invention proposes to integrate a visual indication of the day of a celestial body into a watch, in particular the lunar day, simultaneously with the display of the phase of said celestial body.

It is an object of the invention to ensure both great accuracy as regards observing astral periods, and very good visibility via a three-dimensional display, which is attractive to the user.

The invention therefore concerns a mechanism for displaying the day and phase of at least a first celestial body, comprising a gear train for a constant frequency gear drive on an output of a timepiece movement, said mechanism including a means for the three-dimensional display of the day and phase of said first celestial body represented by a first mobile component, said means being driven by said gear train, which includes a phase train and a day train, each in mesh on an output of the same said movement, characterized in that said phase train, and/or the day train, includes at least one uncoupling means between the input and output thereof.

According to another feature of the invention, said phase train and the day train each include at least one uncoupling means between the input and output thereof.

According to a feature of the invention, the uncoupling means of said day train includes a jumper spring arranged between, on the one hand, a day wheel kinematically connected to the input train from said movement, and on the other hand, a wheel with male wolf teeth, arranged to be driven by said phase train and to cause said first mobile component to pivot.

According to a feature of the invention, the uncoupling means of said phase train is formed by the cooperation between, on the one hand, a cam disposed on the periphery of a snail arranged to be driven by an intermediate wheel which is kinematically connected to the input train from said movement, and, on the other hand, the first arm of a lever; said first arm is returned by an elastic return means towards said cam, and the jump thereof on a slope of said cam causes the rotation of said lever and the movement of a second arm which is comprised therein and which carries a click, arranged to cooperate with said day train and move said train forward one position at the time of said jump.

According to a feature of the invention, said snail is not permanently driven by said intermediate wheel, which carries a toothing with female wolf teeth; said snail carries a click arranged to make the snail pivot integrally with said intermediate wheel, and the jump of said first arm of said lever on said slope of said cam releases said click from said female wolf toothing prior to the re-engagement thereof in position in the next tooth.

According to an alternative feature of the invention, said snail pivots integrally with said intermediate wheel.

The invention also concerns a movement including a drive means for driving at least one such display mechanism.

According to a feature of the invention, said movement includes a day/night drive mechanism and/or a GMT mechanism, for driving at least one mobile component representing a celestial body and/or a semi transparent globe covering one said mobile component.

The invention also concerns an astronomical watch including at least one movement of this type, and/or at least one mechanism of this type.

BRIEF DESCRIPTION OF THE DRAWINGS

Other features and advantages of the invention will appear upon reading the following detailed description, with reference to the annexed drawings, in which:

FIG. 1 is a perspective view of the mechanism alone.

FIG. 2 is a front view of the mechanism alone.

FIG. 3 is a bottom view of the mechanism alone.

FIGS. 4 and 5 are respectively right and left side views.

FIG. 6 is a front view of the mechanism behind a screen in the position in which it is visible to the user.

DETAILED DESCRIPTION OF PREFERRED EMBODIMENTS

Figure 1:
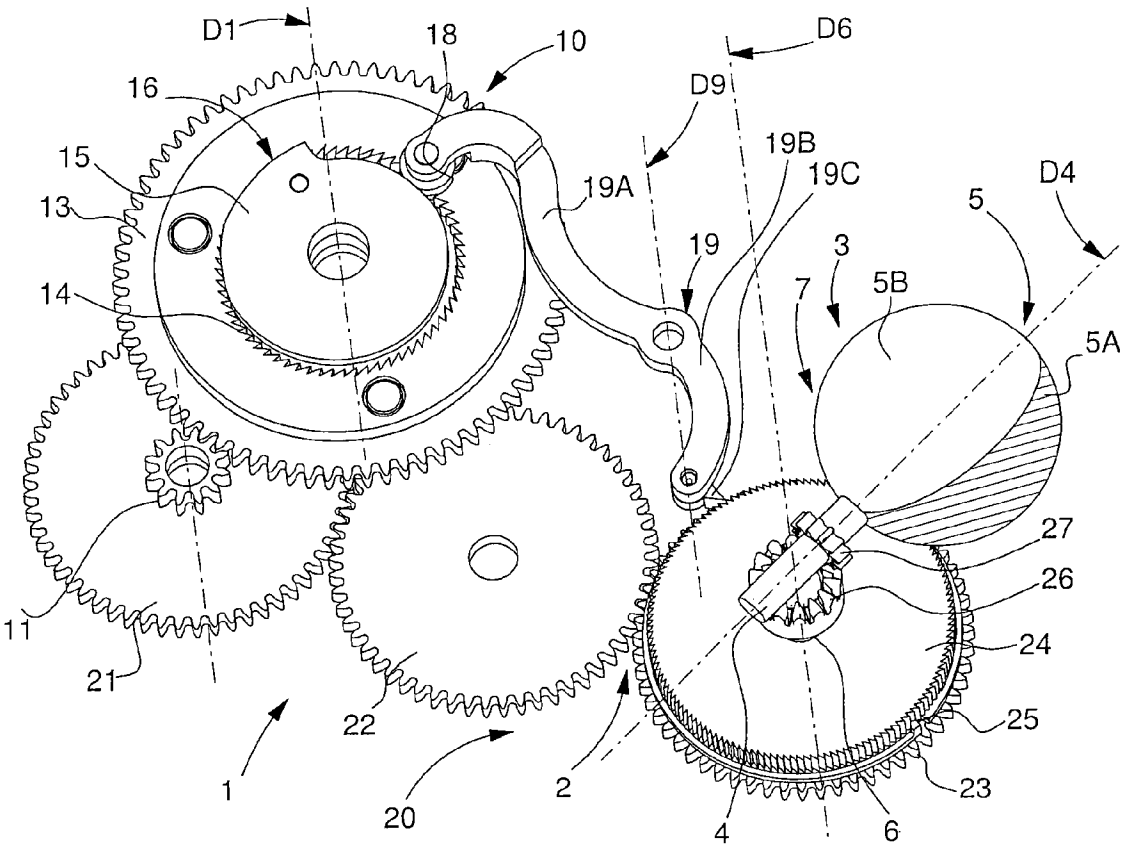
FIGS. 1 to 6 are schematic views of a first variant of the celestial body day and phase display mechanism according to the invention.
Figure 3:
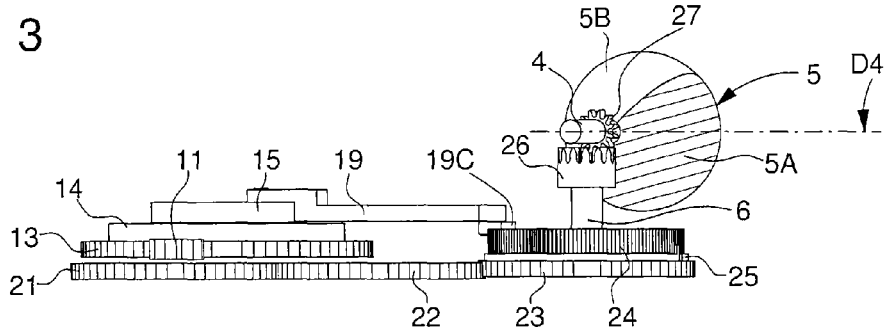

The invention concerns an astronomical timepiece, particularly an astronomical watch, and more specifically a display mechanism for showing the state of at least a first celestial body, whether this is the Earth, a moon or other body.

The invention more specifically concerns the three-dimensional display of the day and phase of a celestial body. The "phases" of a celestial body are, with the exception of the Sun, the successive orientations adopted by the celestial body illuminated by the Sun, where the celestial body is viewed from Earth. In the case of a "planetarium" type timepiece or astronomical clock grouping together the various planets of the solar system and some of their satellites, the phases of these various planets and satellites are viewed, not from the Earth, but from a point in the solar system which is remote from Earth. As a general rule, in this description, the term "celestial body" designates planets and satellites, with the exception of the Sun.

The invention concerns a mechanism 1 displaying the day and phase of at least a first celestial body, comprising a gear train 2 for a constant frequency gear drive on an output of a timepiece movement 100.

The "day" of a celestial body means here the period during which the body pivots on itself and returns to the same visible position with respect to a fixed observer on the Earth.

The "month" of a celestial body means a synodic revolution, i.e. the mean value of the time interval which separates two consecutive conjunctions of the celestial body and the Sun, moments where said body and the Sun have the same celestial longitude, relative to a fixed observer on Earth.

With regard to the Earth, the day and month are to be understood in their normally accepted sense: the 24 hour day is the mean solar day defined by the International Convention of 1955 (in the knowledge that the sidereal solar day is close to 23 hours and 56 minutes, the difference between the true solar day and the sidereal day varying between 3 minutes and 36 seconds, and 4 minutes 26 seconds).

By convention, an element of the mechanism relating to the display of the first celestial body will be termed "first"; an element relating to a second celestial body will be termed "second" and so on.

According to the invention, this display mechanism 1 includes a means 3 for the three-dimensional display of the day and phase of the first celestial body represented by a first mobile component 5, which is driven by gear train 2.

In a preferred embodiment illustrated in the Figures, this three-dimensional display means 3 includes a first phase arbour 4, directly or indirectly pivotally driven by gear train 2.

This first phase arbour 4 carries a first mobile component 5, particularly a first sphere 5, which simulates the first celestial body, and which makes one revolution whose period is the duration of one month of the first celestial body.

A "sphere" hereafter means a mobile component representing a celestial body, 5 or 50, regardless of the actual shape of the mobile component.

Mechanism 1 includes a first day arbour 6, directly or indirectly pivotally driven by gear train 2. The first mobile component 5 or sphere 5 makes one revolution about this first day arbour 6 on an orbit whose period is the duration of one day of the first celestial body.

Gear train 2 advantageously includes a phase gear train 10 and a day train 20, each in mesh on an output of the same movement 100, for example on the cannon-pinion or on a twenty-four hour wheel. Phase train 10 and day train 20 may be driven by different outputs of the same movement, or one by the other or may each drive the other.

FIGS. 1 to 6 illustrate a first variant of a mechanism 1 wherein the first day arbour 6 is pivotally driven by a day train 20, directly or indirectly, from one output of movement 100. The first phase arbour 4, pivoting about an axis D4, is pivotally driven by a phase train 10, directly or indirectly from an output of movement 100.

Advantageously, phase train 10 and/or day train 20 includes at least one uncoupling means between its input and its output. Preferably, phase train 10 and day train 20 each include at least one uncoupling means between the input and output thereof.

In the particular preferred embodiment, the first phase arbour 4 is carried by the first day arbour 6, or by a phase mobile component 7 driven by said first day arbour 6.

Day train 20 includes an input wheel 21, in mesh with a twenty-four hour wheel of the movement, or with an intermediate wheel imparting a twenty-four hour rotation thereto, and corresponds to the duration of the mean solar day. If necessary, input wheel 21 meshes with an intermediate wheel 22, which engages with a first celestial body day wheel 23, or it meshes directly with said first celestial body day wheel 23, according to the required gear reduction, with said wheel 23 completing one revolution in one first celestial body day. First celestial body day wheel 23 is pivotally mounted, about a pivot axis D6, coaxially with a wheel having male wolf teeth 24. Wheels 23 and 24 are connected to each other by a jumper spring 25; action on wolf toothing 24 may uncouple this mechanism and modify their relative angular position. The uncoupling means of day train 20 thus includes this jumper spring 25 arranged between, on the one hand, a day wheel 23 kinematically connected to the input train from movement 100, and, on the other hand, a wheel with male wolf teeth 24, which is arranged to be driven by the phase train 10, and which pivotally drives the first mobile component 5.

Wheel 24 carries the first day arbour 6, which includes a frontal pinion 26.

This frontal pinion 26 meshes with a wheel 27 integral with the first phase arbour 4.

Phase wheel 10 includes an input pinion 11, in mesh with the cannon-pinion of the movement, or with an intermediate wheel which imparts a one hour rotation thereto. Pinion 11 meshes, where necessary, with an intermediate wheel 12, which engages with an intermediate wheel 13, which makes one revolution in a given period, or meshes directly with said wheel 13 as illustrated in FIG. 1, according to the desired gear reduction.

This intermediate wheel 13 comprises an inner set of wolf teeth 14.

Figure 2:
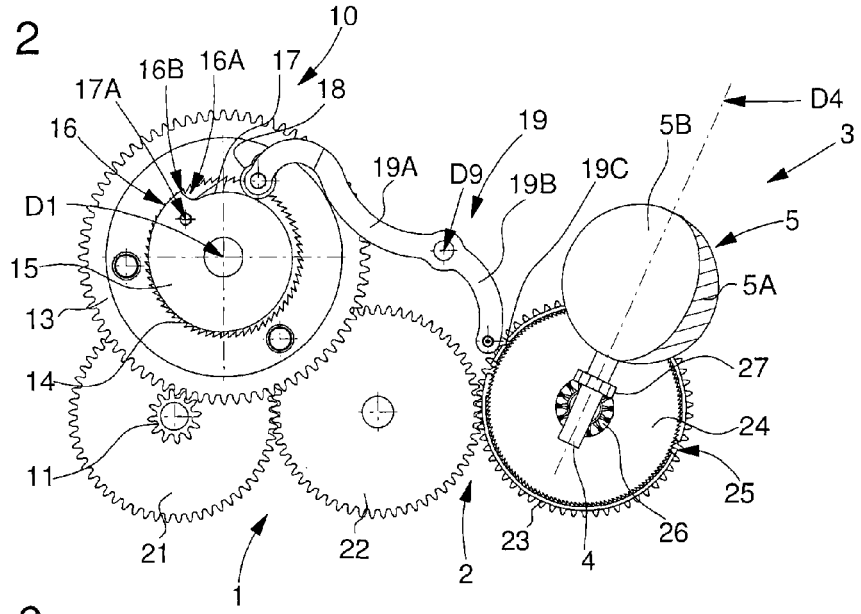

A snail 15 pivots coaxially with intermediate wheel 13 about an axis D1, the periphery 15A thereof forms a cam 16 having a slope 16A delimiting a beak 16B, and having a click 17 with a single tooth which pivots on a pivot 17A and which cooperates with inner toothing 14, as seen in FIG. 2.

A runner 18, particularly a ruby, covers the periphery 15A of snail 15, and is carried by a lever 19, pivotably mounted about an axis D9 relative to the bottom plate of movement 100, and a first arm 19A of which, carrying runner 18, is returned towards snail 15 by a spring (not shown in the Figures).

When, once per revolution of intermediate wheel 13, runner 18 passes from the high point of snail 16 to the low point, passing over beak 16B and slope 16A, it releases click 7, whose tip then takes up the hollow of the next tooth of female toothing 14.

Thus, the uncoupling means of phase train 10 comprise, on the one hand, a cam 16 disposed on the periphery 15A of a snail 15 arranged to be driven by intermediate wheel 13 which is kinematically connected to the input train from movement 100, and on the other hand, the first arm 19A of a lever 19, said first arm 19A is returned by an elastic return means towards said cam 16, and the jump thereof on a slope 16A of the cam causes the rotation of lever 19 and the movement of a second arm 19B which is comprised therein, and which carries a click 19C, arranged to cooperate with the wolf teeth wheel 24 of day train 20 and move said train forward one position at the time of said jump.

In this first variant, snail 15 is not permanently driven by intermediate wheel 13, which carries a female wolf toothing 14; snail 15 carries a click 17 which causes it to pivot integrally with intermediate wheel 13, and the jump of first arm 19A of lever 19 on a slope 16A of cam 16 causes the release of click 17 relative to the female wolf toothing 14 prior to the re-engagement thereof in position in the next tooth.

This uncoupling, combined with a backward motion, enables the phase train to be uncoupled, and the resulting period where the phase train is uncoupled can be adapted as required.

The pitch of the wolf toothing 14 corresponds to a certain elementary duration, according to the number of teeth in the toothing. The length of time until the jump during the next rotation is thus equal to the difference between the duration of the period of wheel 13 on the one hand, and this elementary duration on the other hand.

At the time of this jump, the drop of first lever arm 19A causes lever 19 to pivot; the second arm 19B thereof is provided with a click 19C, which cooperates with wolf tooth wheel 24 of the day train 20.

The following description more specifically concerns a first preferred application of this first variant shown in FIGS. 1 to 6 to the display of the lunar day and phase.

Movement 100 directly or indirectly drives, particularly via the cannon pinion, an input wheel 21 and a pinion 11, which are coaxial in the case of the Figures, but which may equally well have a different arrangement, the arrangement shown being most favourable in terms of space usage.

Input wheel 21 has 57 teeth and makes one revolution in 24 hours. Pinion 11 has twelve teeth.

For determining the lunar month, a first portion of the train formed by day train 20 has two wheels.

Input wheel 21 meshes with an intermediate wheel 22, which also has 57 teeth, which makes one revolution in twenty-four hours.

Intermediate wheel 22 meshes with a lunar day wheel 23 with 59 teeth, which thus makes one revolution in 24 hours 50 minutes and 31.58 seconds.

For determining the lunar phase, a second portion of the train formed by phase train 10, is formed of a very limited number of components.

At the input of the train, pinion 11 with twelve teeth meshes with an intermediate wheel 13 called the six hour wheel, which has 72 teeth and which makes one revolution in six hours.

This six hour wheel 13 has an inner wolf toothing 14 with 64 teeth.

A snail 15 pivots coaxially with six hour wheel 13 and carries a cam 16 including a slope 16A, and a click 17 with a single tooth, which cooperates with inner toothing 14.

A runner 18, particularly a ruby, covers the periphery 15A of snail 15, and is carried by a lever 19, pivotably mounted relative to the bottom plate of the movement, and a first arm 19A of which, carrying runner 18, is returned towards snail 15 by a spring (not shown in the Figures).

When, once per revolution of six hour wheel 13, runner 18 passes from the high point of snail 16 to the low point, passing over slope 16A, it releases click 17, whose tip then takes up the hollow of the next tooth of female toothing 14.

The 0.20000 mm wolf tooth pitch of toothing 14 corresponds to an elementary duration of 5 minutes and 37.5 seconds. The length of time until the jump during the next revolution is thus 6 hours minus this elementary duration, namely 5 hours 54 minutes and 22.5 seconds, i.e. 21262.5 seconds.

With an ideal wolf tooth having a pitch of 0.1999999 mm, the elementary duration would be 5 minutes and 37.98 seconds. The length of time until the jump during the next revolution is thus 6 hours minus this elementary duration, namely 5 hours 54 minutes and 22.0 seconds, i.e. 21262.0 seconds.

At the time of this jump, the drop of first lever arm 19A causes the lever to pivot; the second arm 19B thereof is provided with a click 19C, which cooperates with a wolf tooth wheel 24 with 140 teeth.

This wolf tooth wheel 24 pivots integrally about a pivot axis D6, via a jumper spring 25, of a day arbour 6 carrying a frontal pinion 26 having twelve teeth. This frontal pinion 26 meshes with an arbour wheel 27 with fourteen teeth, integral with a phase arbour 4, which pivots on a pivot axis D4 perpendicular to pivot axis D6. Consequently, the motion of one tooth of wolf tooth wheel 24 is translated into a rotation of: $360°/140\times14/12=3°$ on phase arbour 4.

A complete revolution of arbour 4, which thus corresponds to a lunar month, is completed in 360/3=120 times the length of time between two jumps on cam 16:

$$120\times21262.0=2551440 \text{ seconds, namely } 29.5305833 \text{ terrestrial days.}$$

Accuracy of course depends upon the accuracy of the wolf teeth of toothing 14.

This value is a very good approximation of the lunar month. Indeed, the duration of the lunar month is highly variable, from one month to another within one year, and from one year to another, with values frequently varying from one or two hours per month over consecutive months, and up to six hours per month. The usual and arbitrary value of the synodic lunar month of 29.530589 days is a mean value, which is marred by quite a large range of uncertainty, of around 1%. Consequently, the value established according to the invention is excellent.

Preferably, the mechanism of the celestial body is mysterious, and thus the first phase arbour 4 is made of sapphire or a material having similar characteristics. This type of sapphire arbour having a diameter of 1 mm, combined with a celestial body sphere 5 made of titanium or an alloy of lower or equal density, having a diameter of 5 mm, can easily resist accelerations of 5000 g.

The celestial body sphere 5, a Moon here in this application, carries different displays 5A, 5B, on its two hemispheres.

Figure 6:
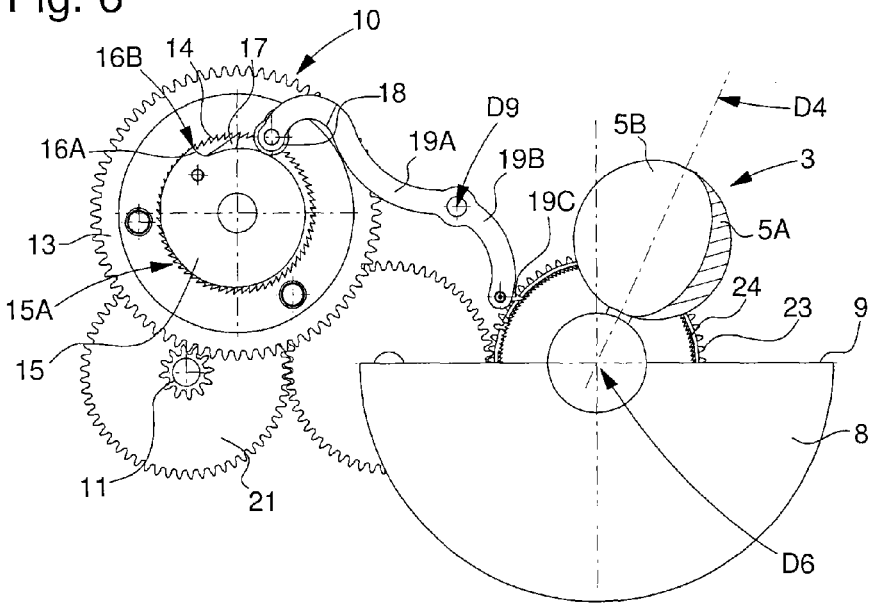
Figure 5:
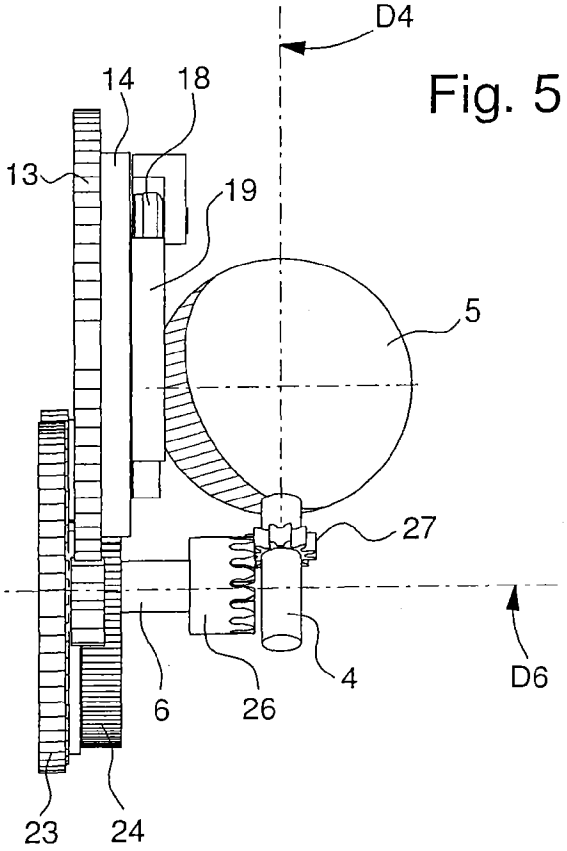
Figure 4:
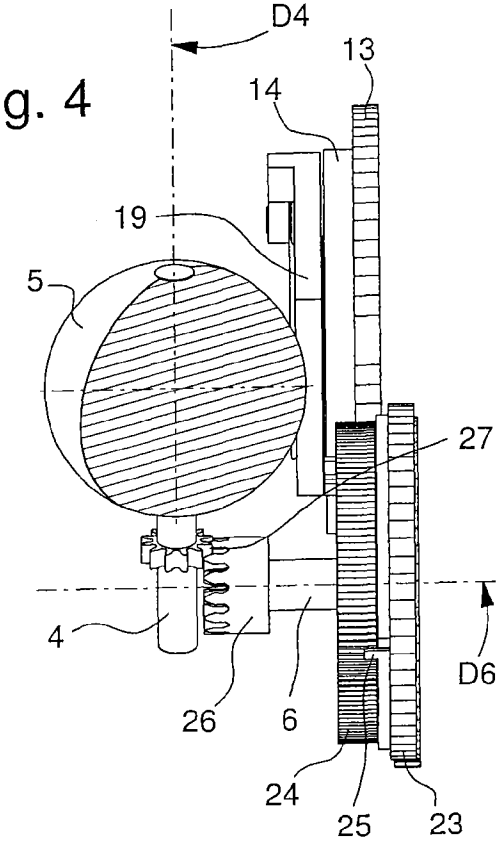

As shown in FIG. 6, the first day arbour 6 pivots about its axis D6, and takes with it as it pivots arbour 4 carrying celestial body sphere 5. This arbour 4 thus makes a rotating motion about axis D6, during which celestial body sphere 5 pivots about axis D4. The trajectory of sphere 5 partially occurs behind a dark screen 8, made of smoked glass or similar, defining a horizon 9 on pivot axis D6 of first day arbour 6. The passing of first mobile component 5 behind the shady portion of screen 8 simulates the position of the celestial body behind the Earth, invisible to the user at the moment concerned, yet allowing the user to see the state of the phase of the celestial body, which explains why screen 8 is dark and not opaque.

Figure 7:
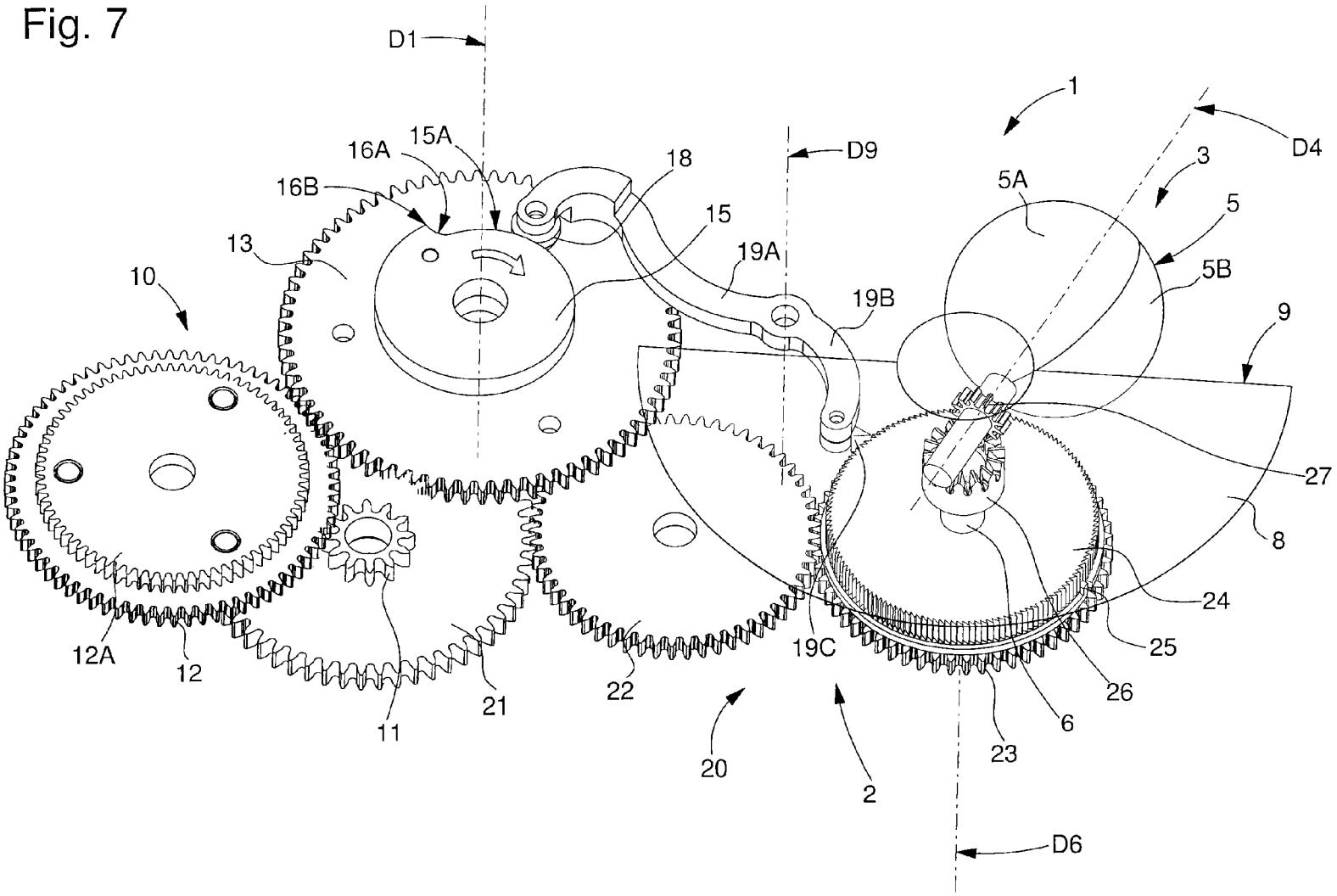
FIG. 7 shows a schematic, perspective view, similar to FIG. 1, of a second variant of the invention, shown with the screen of FIG. 6.
Figure 8:
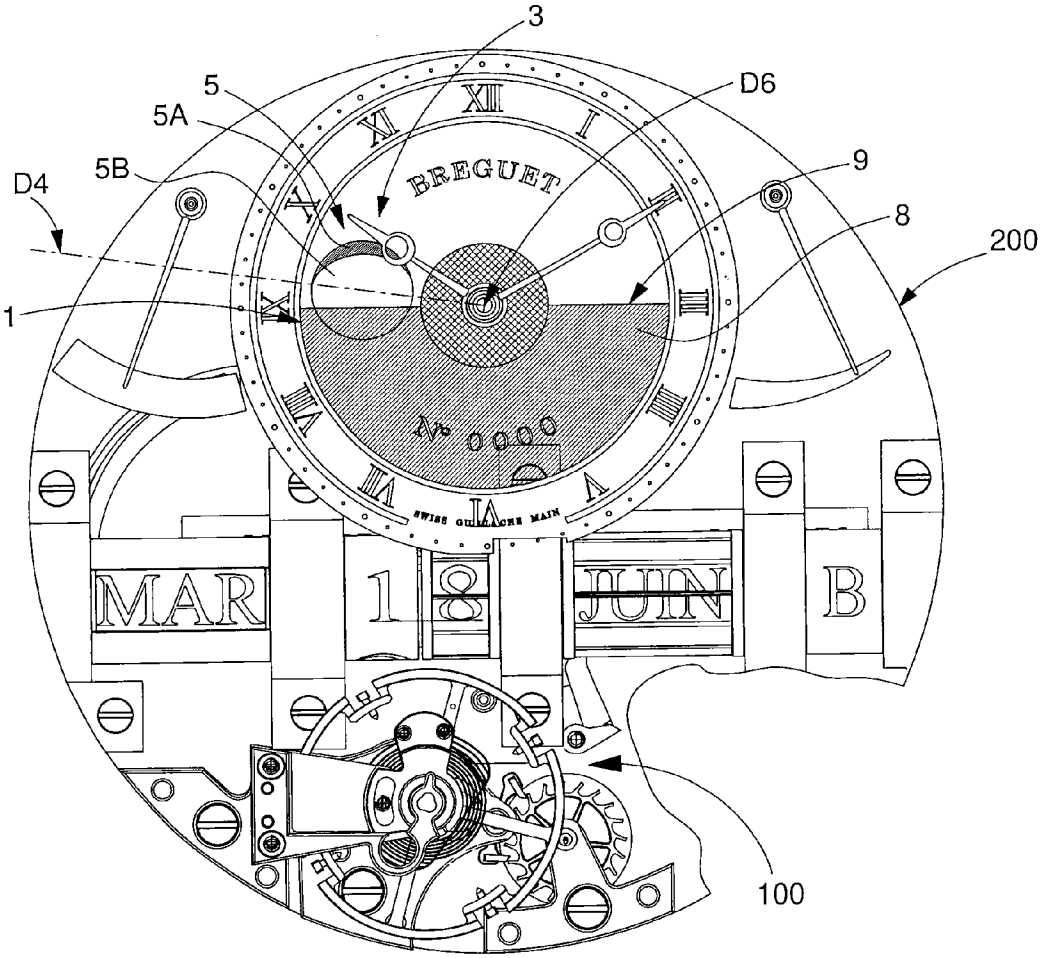
FIG. 8 shows a partial, schematic, front view of an astronomical watch including a three-dimensional Moon display according to the invention.
Figure 9:
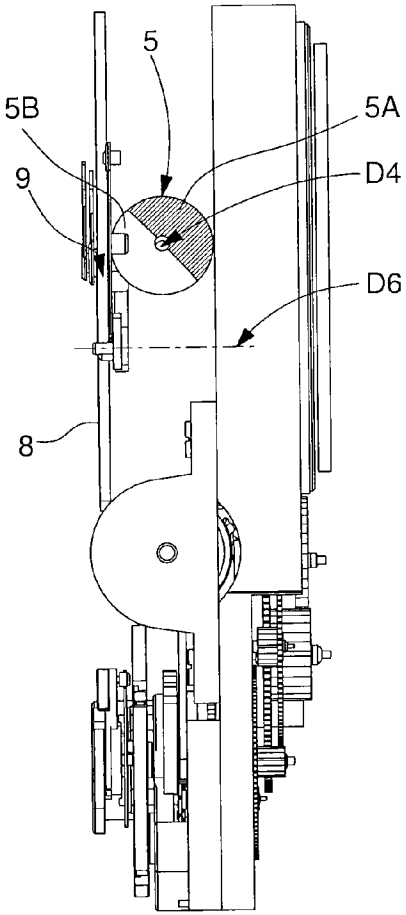
FIG. 9 shows the watch of FIG. 8 in a view from the right.

FIG. 7 illustrates a second variant of the invention, which includes the same day train 20 as in the first variant. Phase train 10 is simplified; female wolf toothing 14 is omitted. The uncoupling means of phase train 10 is the same as in the first variant; however snail 15 pivots integrally with intermediate wheel 13.

Input pinion 11 is still in mesh with the cannon pinion of the movement, or with an intermediate wheel imparting a one hour rotation thereto. Pinion 11 with 12 teeth meshes with an intermediate wheel 12 with 72 teeth. This intermediate wheel 12 is coupled in rotation with a phase wheel 12A having 64 teeth, which engages with intermediate wheel 13 which has 63 teeth.

Snail 15 pivots coaxially with intermediate wheel 13 about axis D1; the periphery 15A thereof forms a cam 16 similar to the first variant of FIGS. 1 to 6.

When, once per revolution of intermediate wheel 13, runner 18 passes from the high point of snail 16 to the low point, passing over beak 16B and slope 16A, it causes lever 19 to pivot, and click 19C to act on wolf tooth wheel 24 of day train 20.

This second variant is more economical to produce than the first variant, because of the smaller number of components and simplified assembly. The combination of toothings results, however, in an error of only 57 seconds per lunar month, which is less than known mechanisms.

The invention is well suited to displaying the state of various celestial bodies, and particularly to a combination of such bodies.

In a variant, the first day arbour 6 is mounted on a day mobile component 41 which makes a circular or elliptical trajectory about a central axis D0. An elliptical trajectory may be obtained by arranging mobile component 41 in a sliding assembly on an arbour, returned by a spring or similar element against an elliptical cam. Day mobile component 41 may also cooperate with an inner circular or elliptical toothing 44 on the trajectory which it is desired to display, as visible in FIG. 10, via an external toothing 43 associated therewith and which is advantageously transparent and made of sapphire or similar, and which rolls in this inner toothing 44.

In a complication of the preceding variant, day mobile component 41 carries at least a second sphere 50 which simulates a second celestial body whose angular position can be adjusted by manual adjustment means 45 or by a GMT time zone adjustment train 46 comprised in movement 100.

Figure 10:
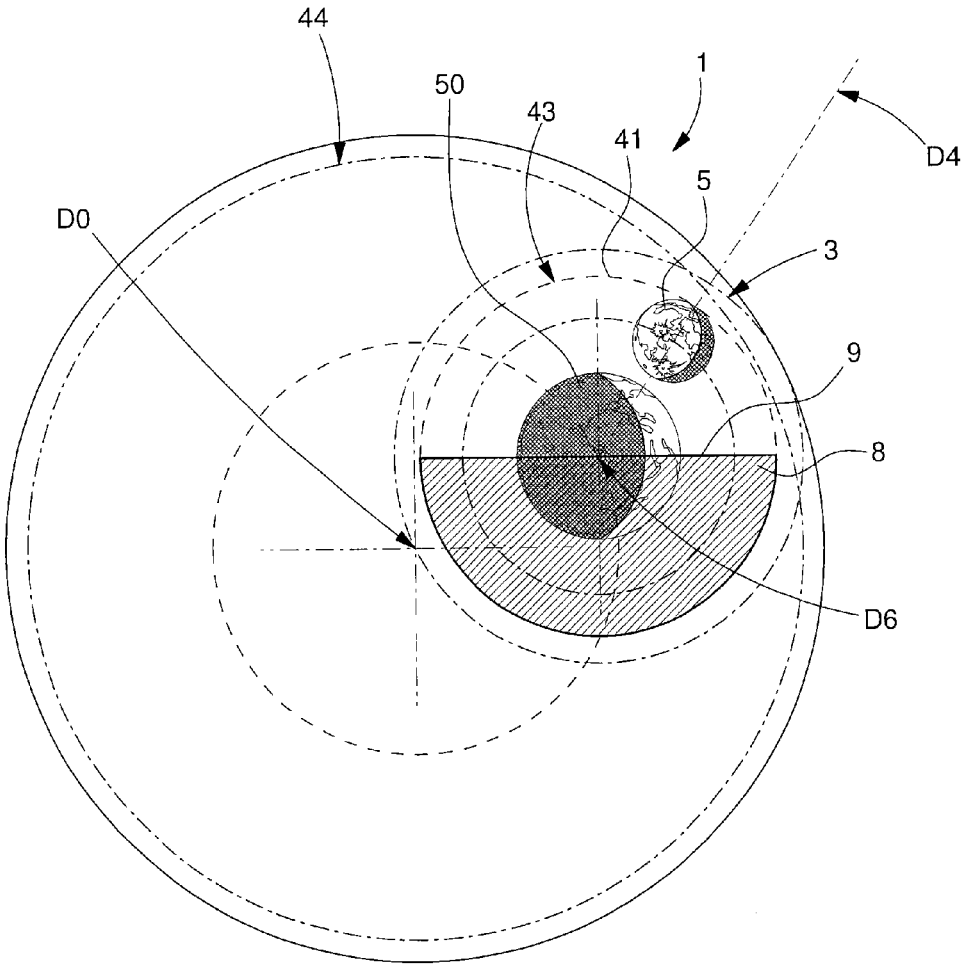
FIG. 10 shows a front view of a variant of the invention with the simultaneous representation of the Earth and the Moon both movable in plane.

For example, FIG. 10 illustrates the relative movement of the Moon and Earth, and the annual orbit of the Earth in a simplified circular form about axis D0.

In a particular variant, the second sphere 50 of the second celestial body, which is the Earth here, while sphere 5 represents the Moon, is surrounded by a third sphere 51, one hemisphere of which is transparent, and which, driven by a day/night drive mobile component 47, makes one revolution whose period is the duration of one day of the second celestial body. Day mobile component 41, however, pivoted directly or indirectly by train 2, makes an eccentric revolution whose period is a sub-multiple or multiple of the second celestial body day, or whose period is the duration of one year of the second celestial body.

Preferably, mechanism 1 according to the invention display the day and lunar phase of the first celestial body, which is the Moon.

In a variant, the second celestial body is the Earth, and mechanism 1 displays, on one hand, the day/night progression in one meridian of the Earth, and on the other hand, the local time of the meridian or the annual position of the Earth on its orbit around the sun.

Figure 11:
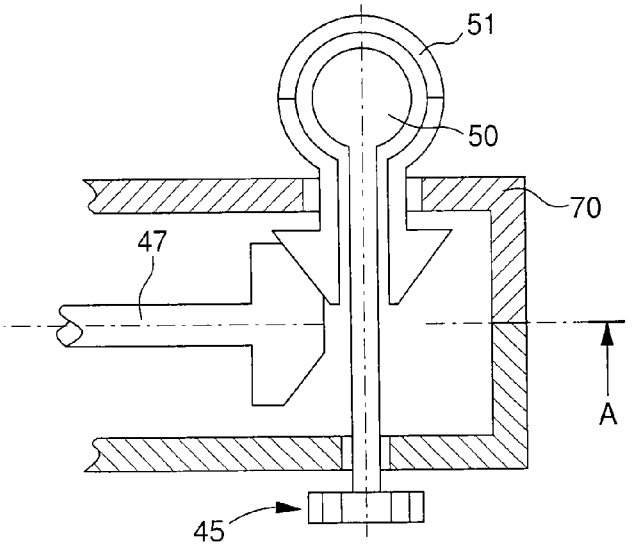
FIGS. 11 to 13 show cross-sections of particular variant representations of celestial bodies in the form of a sphere covered by a globe including a transparent hemisphere and a dark hemisphere, and various possible settings.
Figure 12:
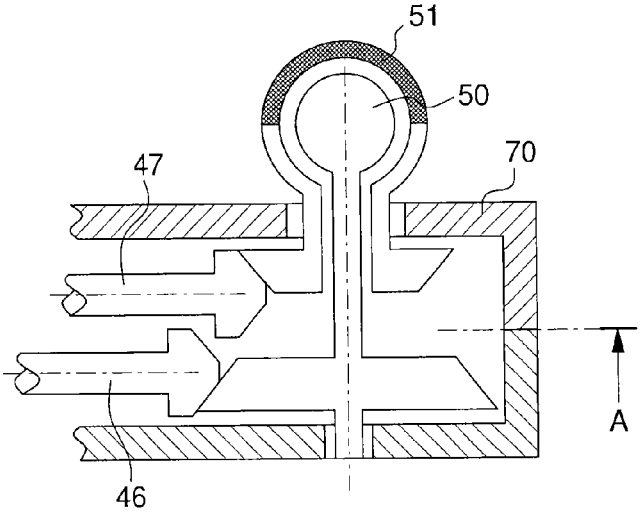
Figure 13:
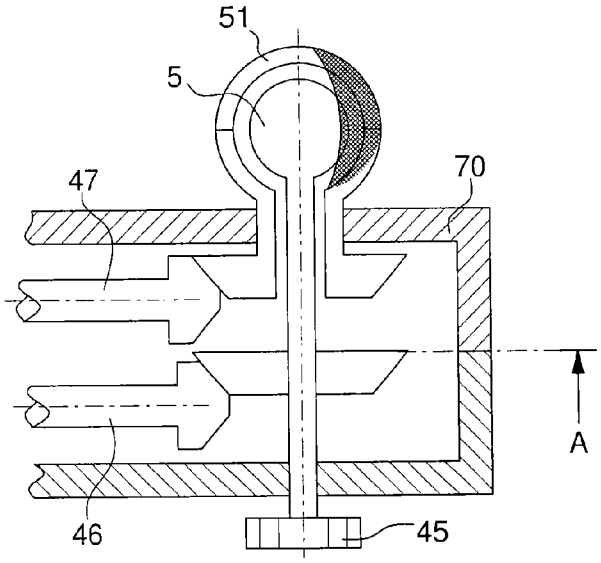

In a particular variant of the invention, sphere 5 symbolising the first celestial body is enclosed in a spherical dome 51 which is transparent over one hemisphere and dark over the other, thus forming a globe with a day portion and a night portion. This globe is pivotally driven. The position of the celestial body in the globe can be adjusted, either by a GMT mechanism as in FIG. 13, or manually, by a control stem 45, on which the intermediate GMT drive wheel is friction mounted. FIGS. 11 to 13 shows an advantageous type of assembly, in which a mobile component symbolising a celestial body 5 or 50 is pivotably mounted in a cylindrical sleeve 70 having an axis A, which can be driven in rotation about this axis. Sleeve 70 may be in two parts to facilitate assembly. Likewise, the spherical portion representing celestial body 5 or 50 is shown enclosed in a hollow globe made of two parts, wherein two hemispheres may be distinguished into day/night in a plane parallel to axis A or perpendicular to axis A.

The invention is equally well suited to representing the Earth, the Moon, or any celestial body with a periodic orbit.

In a particular variant representing the Earth, to display to a user from any area in the world a representation of the Earth in which the user's own country is visible, mechanism 1 includes a means of adjusting Earth sphere 50, either via a stem 45, or via a GMT mechanism 46 if the timepiece has one, which has the advantage of leaving the main display unchanged, while displaying the day-night progression on the GMT time zone which is of interest to the user.

The invention can be used to produce a cosmographic or astronomical or Earth-Moon watch.

For example, in a second GMT time zone, centred on Bolivia in the FIG. 10 example, a moving Earth-Moon unit travels over the large circle in 12 or 24 hours and provides, via its angular position, the local time: here it is 2 o'clock in the morning in Bolivia, which is still in the darkest sector representing the night.

As explained above, within the moving Earth-Moon unit, the Moon rotates about the Earth in one lunar month, while displaying its phases.

In a particular variant, the axis of the poles of the Earth remains parallel to the 12 o'clock-6 o'clock axis, as does the axis of the poles of the Moon.

In a complicated version, the circular representation of the Earth's orbit is replaced by an elliptical trajectory. In both cases, the display may advantageously incorporate, in different variants, display signals pertaining to the equinoxes and solstices, and/or signs of the zodiac, and/or the associated lucky symbols for Asian countries.

Yet another variant consists in the display of the tidal coefficients according to the GMT time zone.

The invention also concerns a movement 100 including a drive means for driving at least one such display mechanism 1. Advantageously, this movement 100 drives certain functions of the display mechanism, such as a day/night drive mechanism 47 and/or a GMT mechanism 46, or similar, for driving at least one mobile component 5, 50, representing a celestial body and/or a semi-transparent globe 51 covering a mobile component 5, 50 of this type.

The invention also concerns an astronomical timepiece, in particular an astronomical watch including at least one movement 100 and/or at least one mechanism 1 of this type.

What is claimed is:

1. A mechanism for displaying the day and phase of at least a first celestial body, comprising a gear train for a constant frequency gear drive on an output of a timepiece movement, said mechanism including a means for the three-dimensional display of the day and phase of said first celestial body represented by a first mobile component, which is driven by said gear train, which includes a phase train and a day train, each in mesh on an output of the same said movement, wherein said phase train, and/or the day train, includes at least one uncoupling means between the input and output thereof.

2. The mechanism according to claim 1, wherein said phase train, and the day train each include at least one uncoupling means between the input and output thereof.

3. The mechanism according to claim 1, wherein the uncoupling means of said day train includes a jumper spring arranged between, on the one hand, a day wheel kinematically connected to an input train from said movement, and on the other hand, a wheel with male wolf teeth, arranged to be driven by said phase train and to pivotally drive said first mobile component.

4. The mechanism according to claim 1, wherein the uncoupling means of said phase train comprise, on the one hand, a cam disposed on the periphery of a snail arranged to be driven by an intermediate wheel which is kinematically connected to an input train from said movement, and on an other hand, a first arm of a lever, said first arm is returned by an elastic return means towards said cam, and the jump thereof on a slope of said cam causes the rotation of said lever and the movement of a second arm which is comprised therein, and which carries a click, arranged to cooperate with said day train and move said train forward one position at the time of said jump.

5. The mechanism according to claim 4, wherein said snail is not permanently driven by said intermediate wheel, which carries a toothing with female wolf teeth; said snail carries a click arranged to make the snail pivot integrally with said intermediate wheel, and the jump of said first arm of said lever on said slope of said cam releases said click from said female wolf toothing prior to the re-engagement thereof in position in the next tooth.

6. The mechanism according to claim 4, wherein said snail pivots integrally with said intermediate wheel.

7. The mechanism according to claim 1, wherein said three-dimensional display means includes a first phase arbour, directly or indirectly pivotally driven by said gear train, said first phase arbour carrying a first mobile component simulating said first celestial body and making a revolution whose period is the duration of one month of said first celestial body, and a first day arbour, directly or indirectly pivotally driven by said gear train, wherein said first mobile component makes one revolution about said first day arbour on an orbit whose period is the duration of one day of said first celestial body.

8. The mechanism according to claim 7, wherein said first day arbour is directly or indirectly pivotally driven by a part of said gear train which is synchronous with said first phase arbour which is directly or indirectly pivotally driven by a first part of said gear train.

9. The mechanism according to claim 7, wherein said first phase arbour is carried by said first day arbour, or by a phase mobile component driven by said first day arbour.

10. The mechanism according to claim 7, wherein the trajectory of said first mobile component partially occurs behind a screen defining a horizon on the pivot axis of said first day arbour.

11. The mechanism according to claim 7, wherein said first day arbour is mounted on a day mobile component which makes a circular or elliptical trajectory about a central axis.

12. The mechanism according to claim 11, wherein said day mobile component carries at least a second mobile component simulating a second celestial body whose angular position can be adjusted by manual adjustment means or by a GMT time zone adjustment train of said movement, said second mobile component is surrounded by a third mobile component having one transparent hemisphere, and which makes a revolution whose period is the duration of one day of said second celestial body, whereas said day mobile component, directly or indirectly pivotally driven by said train, makes an eccentric revolution whose period is a sub-multiple or multiple of the second celestial body day, or whose period is the duration of one year of said second celestial body.

13. The mechanism according to claim 1, wherein the mechanism displays the day and lunar phase of said first celestial body which is the Moon.

14. The mechanism according to claim 12, wherein the second celestial body is the Earth, and in that said mechanism displays, on one hand, the day/night progression in one meridian of the Earth, and on the other hand, the local time of the meridian or the annual position of the Earth on its orbit around the sun.

15. The mechanism according to claim 7, wherein said first phase arbour is transparent or made of sapphire.

16. A movement comprising a drive means for driving at least one said mechanism according to claim 1.

17. The movement according to claim 16, wherein said movement includes a day/night drive mechanism and/or a GMT mechanism, for driving at least one mobile component representing a celestial body and/or a semi transparent globe covering one said mobile component.

18. An astronomical watch comprising at least one said movement according to claim 16.

* * * * *